United States Patent [19]

Dahowski

[11] Patent Number: 4,589,237

[45] Date of Patent: May 20, 1986

[54] STAIR MODULE SUPPORT AND LEVELING CONSTRUCTION

[75] Inventor: Donald E. Dahowski, York, Pa.

[73] Assignee: Quaker Plastic Corporation, Mountville, Pa.

[21] Appl. No.: 606,081

[22] Filed: May 1, 1984

[51] Int. Cl.[3] ..... E04F 11/00; E04H 3/16

[52] U.S. Cl. ..... 52/169.7; 52/184; 52/745; 4/506

[58] Field of Search ..... 4/506, 513; 52/301, 52/184, 169.7, 126.7, 745; 248/354.3, 357

[56] References Cited

U.S. PATENT DOCUMENTS

| | | | |
|---|---|---|---|
| 820,155 | 5/1906 | Tresidder | 52/301 |
| 1,258,409 | 5/1918 | Hill | 248/357 |
| 2,762,599 | 9/1956 | Faris | 248/357 |
| 2,858,694 | 11/1958 | Akins et al. | 52/126.7 |
| 3,641,593 | 2/1972 | Goettl | 4/506 |
| 3,744,198 | 7/1973 | Boassy | 52/184 |
| 3,755,981 | 9/1973 | West | 52/184 |
| 3,848,378 | 11/1974 | Witte | 52/184 |
| 3,952,338 | 4/1976 | Troxclair | 4/172.15 |

FOREIGN PATENT DOCUMENTS

| | | | |
|---|---|---|---|
| 1247969 | 8/1967 | Fed. Rep. of Germany | 248/354.3 |

OTHER PUBLICATIONS

Rovel Installation Instructions, pp. 23a, 23b, 23d, 21.

Step Installation Instructions—Pacific Pool Industries (2 pages).

Construction Tips for Pool Professional 3 pages.

*Primary Examiner*—James L. Ridgill, Jr.

*Attorney, Agent, or Firm*—Arthur J. Plantamura

[57] ABSTRACT

A support system for supporting and securing on a substrate and in the desired position a stair module is described. The stair support arrangement advantageously used with swimming pools includes a vertical post which, at the top, supports the stair bottom through a pad member formed or secured underneath the stair module. The post is secured to the pad through vertical depending extensions formed on the pad member. The arrangement facilitates construction by allowing the support to be installed from the top, i.e. the underside of the stair module, down to the ground or supporting level as distinguished from a conventional block support construction which is built from the ground up. A bolt passes through holes formed in the depending legs and through a hole formed near the top of the post such that the top of the post is spaced from contact with the base of the pad member. Shoes are provided at the bottom of, and secured to the post preferably in conjunction with a reinforcing rod which is secured near the lower part of the post. The stair module with the underneath supporting post assembly secured to the stair module is lowered in place and leveled. The bottom of the post, the shoes and the reinforcing rod are then buried in concrete to provide a footing.

16 Claims, 6 Drawing Figures

STAIR MODULE SUPPORT AND LEVELING CONSTRUCTION

This invention relates to stair module support system and in a particular embodiment to construction of a support system for stairs that are of a-modular construction and are used with swimming pools.

BACKGROUND OF THE INVENTION

In the past, installation of support systems for modular unit stairs that are prefabricated and carried to the site for installation has presented a time-consuming and tedious operation; thus installation of these stair units have been of considerable expense. Additionally, the stability against shifting or settling of the stair module in the resulting installations, using prior art techniques, often have been unsatisfactory.

The method commonly used, and disclosed for example in connection with FIG. 17 of U.S. Pat. No. 3,848,378, involves the construction under the stair module of supplementary supporting means in the forms of columns or "piers", usually two or more, which usually comprise stacks of concrete blocks and/or bricks which rest on a suitable concrete footer and which are but up to and abut the underside of one or more steps of the stair module. The footer itself, which rests on an earth base, presents considerable problems in proper construction to produce a footer that is level and resists subsequent settling and/or misalignment. Such piers or columns in prior art support systems are formed from concrete blocks and/or bricks and require that the support system be built under the stair module and from the ground up to provide support for the stair module. To insure proper leveling, in addition to blocks and bricks, shimming is generally needed to attain a precisely leveled plumb condition of the stair unit particularly when the modular stair unit is used and must be precisely aligned with the contiguous swimming wall panels and coping.

It is accordingly apparent that in the past the construction support structures of this kind has been cumbersome and relatively costly to construct. There is, therefore, a need for an improved system for supporting molded one-piece swimming pool stair modules in a relatively expeditious, reliable and less costly manner.

SUMMARY OF THE INVENTION

In accordance with the invention, the aforementioned difficulties of constructing a stair module support system are overcome by a novel system which employs support posts in conjunction with under-the-stair plates or pads at the top of the post and shoe footings at the lower end of the post. The nature of the novel structure of the invention also facilitates the manner in which the support system is installed.

The invention is directed particularly to a support system for stair modules or "shells", primarily those that comprise a plurality of, i.e. two or more, steps. In the system of the invention, means is afforded for supporting the stair module from the top down to the support level, as distinguished from a system in which the support comprises building up from the ground to the underside of the stair module. In the invention, support plates or pads are used which are bonded, or otherwise secured on, or formed integrally on, the underside of the steps of the stair module. The support pad is secured by pins or bolts to a vertical support post through extensions or protrusions which are formed on the support pad. By this arrangement of connecting the pad to the support post, through the extensions fromed on the pad any load, such as that of the water and/or persons placed on the stairs, is distributed evenly across the area of the pad and then to the support post which is bolted to the pad and to the ground or substrate. This arrangement has the effect of allowing the equal distribution of load through the pad and into the post by a means which avoids having the support post contact directly the pad's underside; contact of the support post with the pad is essentially through the bolt or pin which secures the vertical support post to the pad.

A support shoe which may be placed at the bottom of the support post is connected to the bottom of the post and used in conjunction with a reinforcing rod (rerod). The rerod and support shoe are buried in concrete. The system affords a greater surface area on which to distribute any weight placed on the stairs. The stair shell or module support system of the invention thus essentially comprises an arrangement in which the stairs are supported by vertical posts in conjunction with support pads that are bonded to the underside of the steps. The pads have depending legs or protrusions which are provided with securing means, such as holes in alignment with similar holes in the upper end of the posts, to receive a bolt or pin for securing the posts to the support pad. The holes in the post and pad are so arranged as to position the top end of the posts in spaced relationship with the base of the pad for providing equal dispersion of the load on the stairs to the pad, from the pad through the connecting protrusions formed on the pads, through the connecting pins and thence to the vertical supporting post to the underlying ground or other support.

The lower end of the post may rest upon a shoe placed on the ground or substrate and secured to the bottom of the post. The shoes are so constructed as to suitably support the vertical posts and may have a construction similar to the support plates having vertical or protrustions or extensions and holes therethrough which receive a rerod or a pin to secure the posts to the shoes. The holes in the shoe extensions match in line holes provided in the lower end of the posts.

The lower ends of the posts may also have additional holes to receive a second rerod also horizontally disposed and in spaced relation and preferably at an angle substantially perpendicular to the lower rerod. The support shoes and rerods are suitably buried in concrete for greater strength. To enhance load support, additional posts may be added to engage the underside of additional steps of the stair module. A common rerod may be inserted thru the lower ends of the posts and thru the respective shoes of a pair of such vertical support posts.

DETAILED DESCRIPTION

Figure 1:
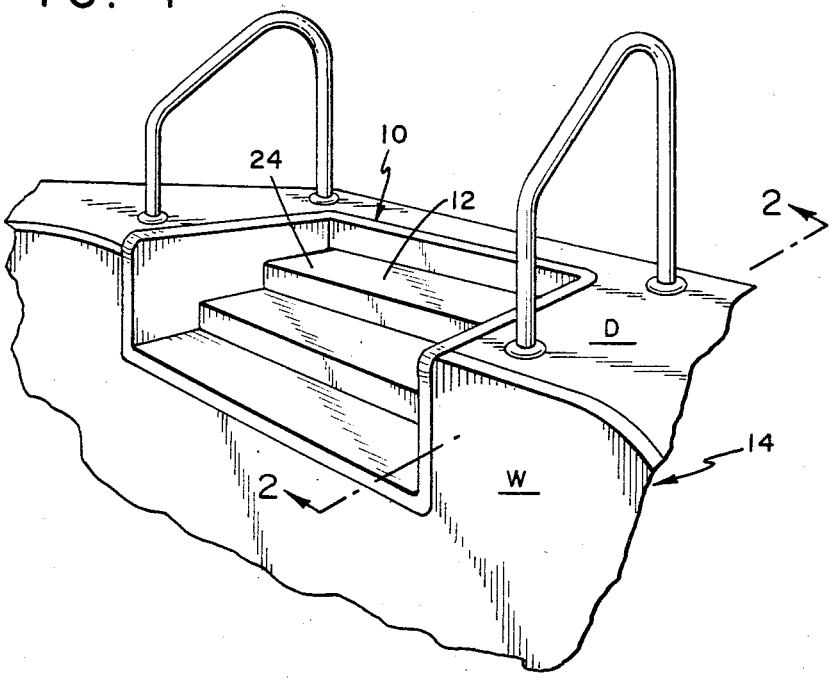
FIG. 1 is a perspective view of a typical stairwell installation shown in relationship to contiguous fragments of a swimming pool wall and deck.
Figure 2:
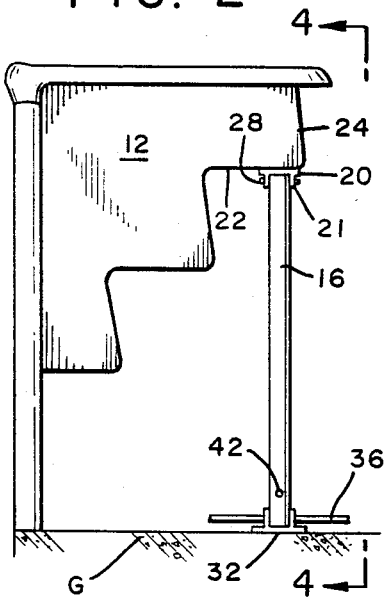
FIG. 2 is a view of the stair support system taken along line 2—2 of FIG. 1 illustrating one of a pair of supporting vertical posts connected to the underneath of the top step of a stair module.
Figure 4:
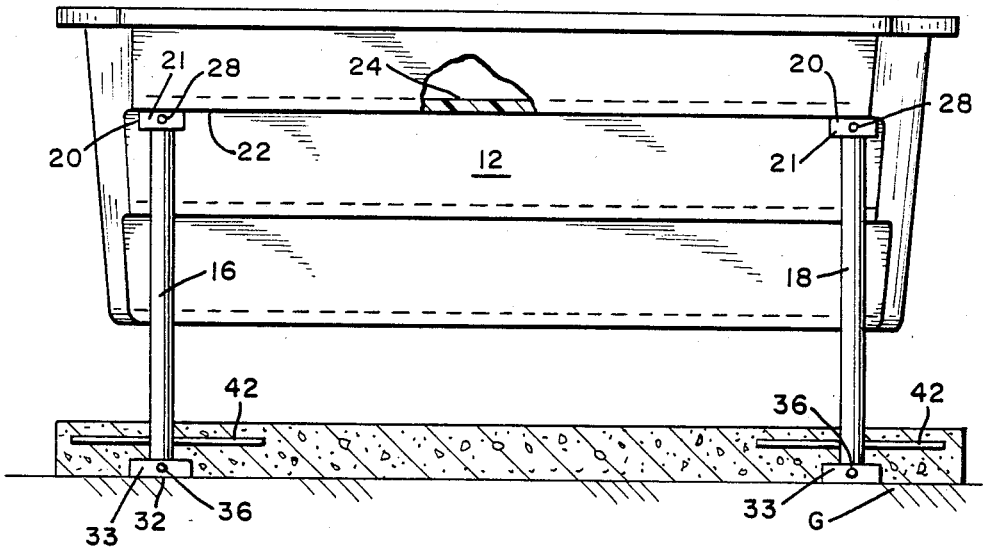
FIG. 4 is an elevational view taken along line 4—4 of FIG. 2.
Figure 6:
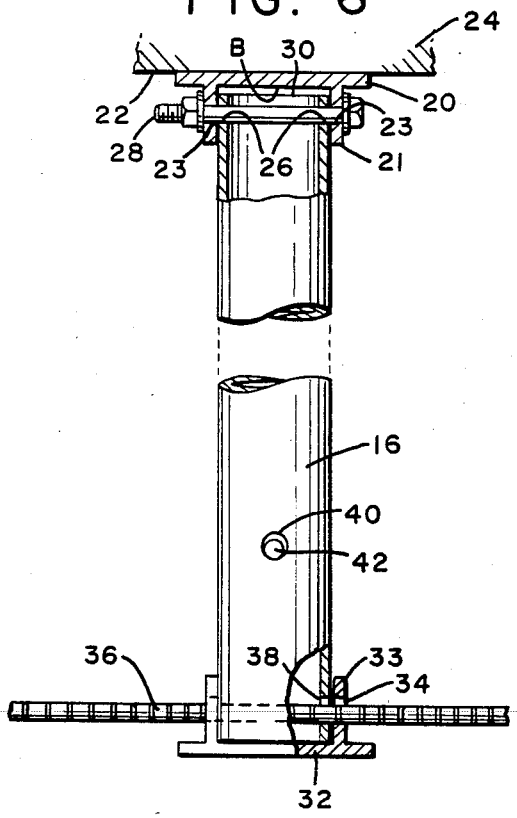
FIG. 6 is a view similar to FIG. 5 as fiewed in the direction of line 6—6 of FIG. 5.

Referring more particularly to the figures of the drawing, a stair well installation generally indicated as 10 is shown in FIG. 1 with a stair shell or module 12 in position within a fragment of a pool 14. The stair shell 12 is shown in place in an opening in the vertical pool wall W and horizontal deck D and is supported beneath by two support posts 16 and 18 as better shown in FIG. 4. In the novel stair module supporting arrangement of the invention, plates or pads 20 are bonded to, or otherwise formed, such as by molding on the underside 22 of the upper step 24. The plates or pads 20 have suitable protrusions which may take the form of depending sides or extensions or legs 21 which are provided with holes 23 in alignment with similar holes 26 in the upper end of the vertical support posts 16 and 18 to receive a bolt or pin 28 for securing the posts to the support plates 20. The cooperating holes in the legs of the pad 20 and in the posts 16 are so arranged as to allow the positioning of the top end 30 of the posts 16 preferably in spaced relationship to the base B of the pad 20 so that distribution of the load which is applied evenly over the area of the pad 20 is through the extensions 21 to the posts 16 (and 18), as best shown in FIG. 6.

Figure 5:
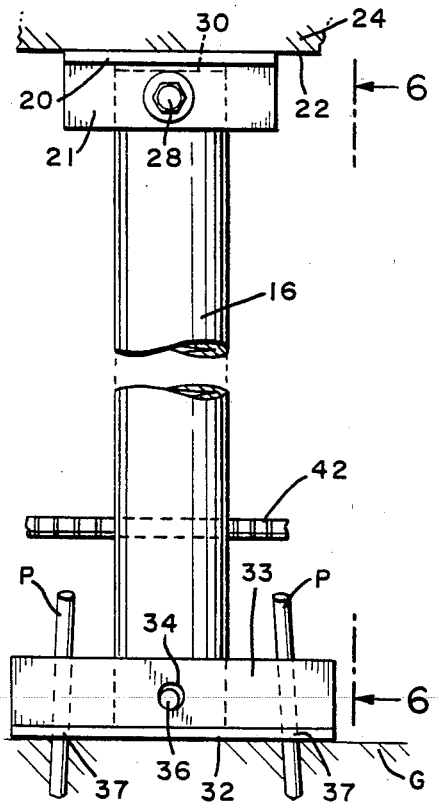
FIG. 5 is an elevational view of one of the posts illustrating in greater detail upper and lower connections for the support system of the invention.

The lower ends of the posts 16 and 18 preferably rest upon shoes 32 on the ground G. The shoes 32 may be constructed similarly to the support plates 20, and may be formed of metal or a suitable plastic, having vertical extensions or legs 33 and having holes 34 in the legs 33, which receive a rerod 36 to secure the posts to the shoes 32, as best shown in FIGS. 5 and 6. The holes 34 match inline holes 38 in the lower end of the posts 16 and 18 and are considerably oversize to allow adjustment of the shoe on the ground to accommodate minor unevenness in the ground or substrate. The shoes 32 may also be provided with securing means such as holes 37 to insert securing anchoring stakes or pins P.

Figure 3:
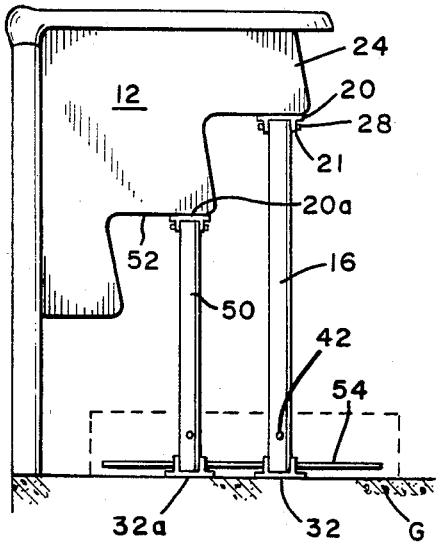
FIG. 3 is a view similar to FIG. 2 showing an alternate arrangement showing one each of two pairs of support posts connected to the underneath of two different steps of the stair module.

The lower ends of the posts 16 and 18 also have holes 40 to receive a second rerod 42 horizontally disposed and in spaced relation and preferably perpendicular to the rerod 36. The support shoes 32 and rerods 36 (and 42) are then buried in concrete (FIG. 4) for greater strength. Also, depending on the size of the stair shell or for greater load support, additional posts 50 may be added and secured underneath another step of the stair module, e.g. under the next lower step 52 of the module as seen in FIG. 3 and, if desired, the posts aligned and a common rerod 54 inserted thru the lower ends of the posts 50 and 16 and thru their respective shoes 32 and 32*a*.

The top of post 50 similarly as described above in connection with posts 16 and 18 is provided at the top with a pad or plate 20*a* similar to that described above and shown in greater detail as 20 in FIGS. 5 and 6, These pads also have depending legs and holes similar to those of pad 20 and are arranged so as to keep the top of the post at a spaced distance from the base B of the plate 20 by means of pins or bolts passing through the holes 23 in the legs 21 and in holes in the posts formed contiguous to the top of the post.

The stair shell or module contemplated for use in the invention comprises stairs prefabricated and carried to a construction site and made from any of a wide variety of materials such as metal, wood or plastic and preferably of a high strength plastic such as fiberglass, reinforced plastic or any suitable thermoplastic or thermosetting high impact resin such as polycarbonate, acrylonitrile-butadiene-styrene, available as Rovel-/ABS Laminate from U.S. Rubber Co., polyvinyl chloride, nylon and the like.

It is thus seen that the arrangement for supporting the stair shell in accordance with the invention affords a reliable and durable support system which is economical and relatively expeditious to install.

An inherent advantage of the support system of the invention resides in that it substantially facilitates the installation of the stair modules by allowing the support method to progress from the top down. In other words, in the support system of the invention, the construction comprises securing the post at the top to the underside of the stairs and "building" down to the ground or support level as distinguished from the conventional block method of supporting stairs by building from the ground or underlying substrate up to the underside of the stairs. The building up with blocks method is relatively inferior from a practical standpoint. Aside from the time-consuming operation using blocks, past experience has shown that many times shims that are used in attempting to attain a level installation slip or the earth settles before the integrity of the support can be established and the whole block support arrangement is disturbed.

An advantage found by the support system of the invention, where the top of the support post is kept from engaging the base B of the pad 20, is that unsightly "imprints" on the stair tread, which tends to form when a support post rests directly against the bottom of the stair tread, is obviated. This is accomplished as described hereinabove by bolting the support post into the two perpendicular legs which depend from the plate or pad placed underneath the stair so that the load on the stair is transferred from the pad substantially evenly through its perpendicular leg extensions 21 into the support posts through the pin or bolt 28 which secures the post; the top of the post being spaced from the pad bottom, avoiding substantial pressure between the top of the post and the pad bottom. It is thus seen that the construction comprising the system of the invention distributes the load substantially more evenly through the pad underneath the stair and into the post so that the top of the post does not rest on the under side of the pad or plate; the post being only in contact with the pad primarily or preferably only through the perpendicular legs depending from the pad through the bolt that passes through the legs of the pad and the post. This connection at the top of the post coupled with the support shoes which conveniently rest on the ground and secure the bottom of the posts and are buried in concrete preferably in conjunction with reinforcing rods afford an optimum weight distribution capability for spreading the weight of water and of persons on the supported stair shell.

With the system of the invention it has been found also that the chore of leveling the stair module, as compared to prior methods, is substantially facilitated because of the method of working down from the underside of the stair module to the support (ground) level.

The stair module support system of the present invention has particular applicability to below-ground swimming pools. However, the system of the invention is also substantially advantageous when applied to stair modules for above-ground swimming pools leading from the elevated deck down to the bottom of the pool interior and/or from the deck down to the ground level of the pool interior and/or from the deck down to the ground level exterior to the pool.

In a typical installation of the support system of the invention, the modular stair unit is brought on site and the vertical posts are secured to the pads on the underside of the step. Optionally, the shoes and rerod may be affixed at the lower end of the vertical support posts. When the support system is to be installed in the ground, a suitable excavation is made in the ground to a suitable depth to accommodate the shoes and rerod. Preferably, the excavation is measured and dug to a level slightly less than the desired level. The stair module containing the post supporting assembly attached to its underside is then placed in position and the ground scraped as necessary to bring the stair module to a level condition. When installed contiguous to an opening formed in a pool wall, the stair module is aligned with the opening and the ground beneath the posts is removed until the desired alignment of the sides of the stair module with the pool wall is achieved. The shoes are then staked to hold the module and support system in place and a concrete footing is poured around the base of the vertical support posts and over the staked shoes and reinforcing rods.

Although the invention has been described and illustrated in its preferred embodiment, it will be understood that the invention is not to be limited to the precise details illustrated and described since various modifications which fall within the scope of the invention as claimed hereafter will be apparent to one skilled in the art.

What is claimed is:

1. A support for securing in place on a substrate a preformed one piece stair module comprising:

(A) a support pad secured at the underside of a step of the stair module, said pad having a flat base portion and being provided with a depending extension;

(B) a vertical support post having its top positioned in said depending extension and connected to said pad through said depending extension; and wherein the top of the vertical support post is underneath and spaced from and is connected to said pad so that the top of the post is spaced from the base of the pad.

2. A support system of claim 1 which comprises a plurality of said support pads and vertical posts and said anchoring means comprises a concrete footing.

3. A stair module support system in combination with a swimming pool wherein the stair module which provides access from the pool deck to the pool bottom is supported in accordance with claim 1.

4. The support system of claim 1 wherein the bottom securing means comprises a support shoe.

5. The support system of claim 4 wherein the means for anchoring the bottom securing means comprises a concrete footing.

6. The support system of claim 5 further provided with a reinforcing rod which passes through a lower portion of said post and is embedded with said shoe and bottom portion of said post in the concrete footing.

7. A stair module support system in combination with a swimming pool wherein the stair module which provides access to the pool interior to the deck level is supported in accordance with the support system of claim 4.

8. A method for supporting and leveling a preformed stair module on a substrate which comprises securing a support pad on the underside of a step of said module, wherein said pad is provided with vertically depending extension for connecting essentially through said extension a support post, securing to said vertically depending extension and underneath said stair a vertical support post so that it engages said pad through said depending extension and so that the top of the post does not engage the base of the pad and said post extends downward contiguous to a substrate to position the thus assembled stair module and support post in the desired position and securing said stair module to the substrate.

9. The method of claim 8 wherein the substrate is the ground and the stair module is secured to the ground by pouring a concrete footing around the bottom of the vertical support post.

10. The method of claim 8 including the step of providing the bottom of said support post with a shoe resting on the ground and securing said shoe to said support post and embedding same in the concrete.

11. The method of claim 10 wherein the shoe secured at the bottom of the post is adjustable and adjusting same to conform to the supporting ground level.

12. The method of claim 9 further comprising securing a reinforcing rod on said support post and securing said shoe to said post and embedding said reinforcing rod in said concrete footing.

13. The method of claim 12 further comprising providing an additional reinforcing rod and positioning same through said post contiguous to but above and at an angle to the reinforcing rod which secures said shoe to said post, and embedding said additional reinforcing rod in said concrete footing.

14. The method of claim 8 as applied contiguous to the opening of a vertical wall in a swimming pool.

15. The method of claim 14 wherein the swimming pool is a below-ground swimming pool.

16. The method of claim 14 wherein the swimming pool is an above-ground swimming pool.

* * * * *